US006092623A

United States Patent [19]

Collavino

[11] Patent Number: 6,092,623

[45] Date of Patent: Jul. 25, 2000

[54] SAFETY ANCHOR SYSTEM

[76] Inventor: Loris Collavino, 5940 Concession #5, Amherstburg, Ontario, Canada, N9V 2Y9

[21] Appl. No.: 09/344,254

[22] Filed: Jun. 25, 1999

[51] Int. Cl.[7] ..... A62B 35/00

[52] U.S. Cl. ..... 182/3; 182/45

[58] Field of Search ..... 182/3, 45; 248/228.3

[56] References Cited

U.S. PATENT DOCUMENTS

| | | | |
|---|---|---|---|
| 140,136 | 6/1873 | Holt et al. . | |
| 2,179,173 | 11/1939 | Boomgarden . | |
| 2,190,328 | 2/1940 | Hans . | |
| 2,650,787 | 9/1953 | Valentine . | |
| 3,137,487 | 6/1964 | Lesser . | |
| 3,217,833 | 6/1964 | Smith . | |
| 3,938,619 | 2/1976 | Kurabayashi et al. . | |
| 4,052,028 | 10/1977 | Cordero, Jr. . | |
| 4,188,023 | 2/1980 | Whaley et al. . | |
| 4,499,966 | 2/1985 | Milne et al. . | |
| 4,542,804 | 9/1985 | Power . | |
| 4,607,724 | 8/1986 | Hillberg . | |
| 4,852,692 | 8/1989 | Flaherty . | |
| 4,928,790 | 5/1990 | Franks . | |
| 5,092,426 | 3/1992 | Rhodes . | |
| 5,433,044 | 7/1995 | Walcher et al. . | |
| 5,522,472 | 6/1996 | Shuman | 182/3 |
| 5,711,397 | 1/1998 | Flora et al. . | |
| 5,850,889 | 12/1998 | Rexroad | 182/3 |
| 5,863,020 | 1/1999 | Olson | 182/3 |

*Primary Examiner*—Alvin Chin-Shue
*Attorney, Agent, or Firm*—Howard & Howard

[57] ABSTRACT

A safety anchor system provides protection to workers that are working on an elevated platform. The safety harness system preferably includes two anchoring devices that are spaced apart on a concrete slab. An extension member extends between the anchor devices. Each individual has a tether that extends between a safety harness worn by the individual and the extension member. The tether is moveable along the entire length of the extension member, which results in a greatly increased range of available motion to the worker. The anchor devices preferably have latching members with extensions of varying dimensions to accommodate a variety of concrete slab configurations.

17 Claims, 2 Drawing Sheets

SAFETY ANCHOR SYSTEM

BACKGROUND OF THE INVENTION

This invention generally relates to a safety anchor system for protecting workers from falling off of elevated work platforms. More particularly, this invention relates to a anchor system that provides a greater range of movement for an individual while simultaneously providing protection from falling off an elevated platform or surface.

There are many instances where construction workers have to work on elevated surfaces during the construction of a building. Because the building is still under construction, walls are typically not in place and there is a potential for an individual to fall off of an elevated platform or surface.

A variety of devices have been developed or proposed to protect individuals from falling under such circumstances. Previous devices, however, have two major shortcomings. First, they typically are not adaptable to being used in a variety of situations or environments. Second, the available range of motion to a worker is often too limiting, which makes the device inconvenient and inefficient to use under most circumstances. The range of motion is restricted by the length of a tether, which must have a limited length in order to provide adequate protection.

One example device is shown in U.S. Pat. No. 4,928,790, which issued on May 29, 1990. One drawback associated with that device is that it requires a work surface having vertical side projections that are perpendicular to a work surface so that the anchorage pads have a surface to engage to lock the safety device in place. Such an arrangement has limited application because not all elevated work platforms have a sufficiently perpendicular orientation of the vertical surfaces to support the anchorage pads. For example, concrete slabs that are typically used in the construction industry often have a generally trapezoidal cross-section, which does not include truly vertical side walls. Therefore, the device of the U.S. Pat. No. 4,928,790 is not believed to be effective to make a connection with such concrete slabs.

Another example device is shown in U.S. Pat. No. 5,711,397, which issued on Jan. 27, 1998. The device of that patent is limited to being used with steel construction to protect steel workers. The device shown in that patent is not versatile enough to be used when the elevated platform is made from concrete slabs, for example.

In view of the shortcomings and drawbacks of currently available or proposed systems, it is desirable to provide an improved safety anchor device to protect workers from falling off of an elevated platform. This invention addresses the need for a safety anchor system that is adaptable to be used in a wider variety of circumstances. Additionally, the safety anchor system of this invention provides greatly increased mobility for an individual working on an elevated surface while simultaneously providing the level of protection required to avoid injury from a fall.

SUMMARY OF THE INVENTION

In general terms, this invention is a safety anchor system for protecting an individual from falling from an elevated platform. The system includes a first anchor device that has a first member and a second member that is moveable relative to the first member to selectively adjust a width of the first anchor device. The first and second members each have an outward end with a latching member supported on the outward end. The latching member is adapted to latch onto an edge of a concrete panel when the width of the anchor device is appropriately adjusted. A second anchor device, much like the first anchor device, is also provided. An extension member extends between the first and second anchor devices and is secured to each of them. At least one tether has a first end secured to the extension member so that the first end of the tether is moveable along the entire length of the extension member. A harness is secured to a second end of the tether and the harness is adapted to be worn by an individual.

In the preferred embodiment, the extension member is a cable that extends between the first and second anchor devices. One of the anchor devices preferably includes a spool that receives a portion of the cable, depending on how far apart the two anchor devices are spaced. A rachet mechanism preferably is provided to maintain tension on the cable after it has been secured to the anchor devices, which have been positioned on the elevated platform as desired.

Another possible use of a system designed according to this invention is to replace the double lanyard arrangement with a single tie off point. This provides a constant tie when necessary.

Another feature of the preferred embodiment of this invention is that the latching members of each anchor device have two possible positions to accommodate differing widths of concrete slabs. Each latching member effectively has two different hooks that are sized to accommodate different sizes of concrete panels. The concrete panels preferably include a groove along a side surface that receive the hook part of the latching member.

This invention also provides health and safety advantages. The amount of movement of the anchors is reduced, which reduces the mechanics of bending and lifting. Therefore, the potential for back injuries and muscle strain is minimized.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENT

Figure 1:
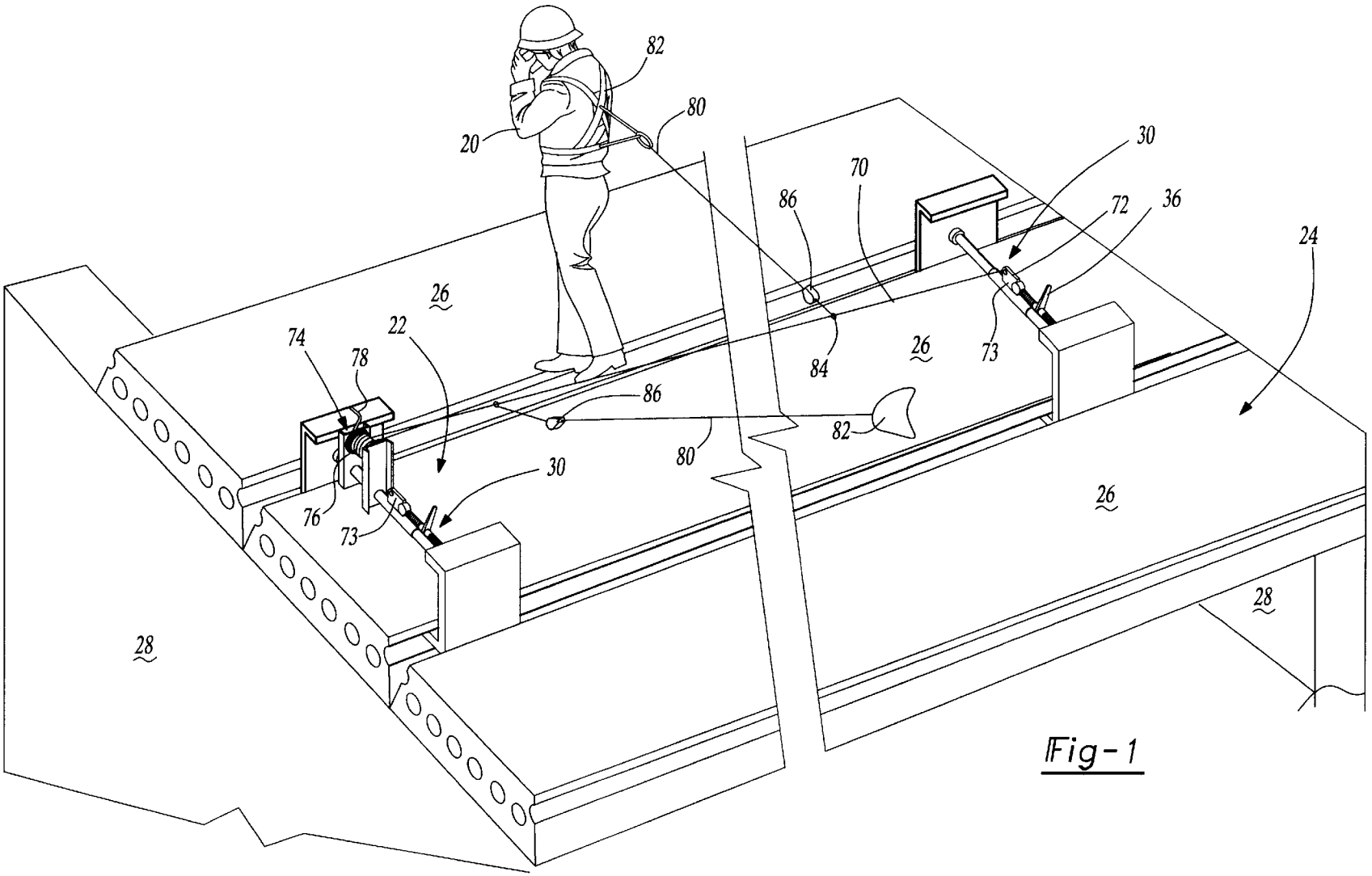
FIG. 1 diagrammatically and schematically illustrates a safety anchor system designed according to this invention as used on an elevated platform.

FIG. 1 illustrates a worker 20 utilizing a safety anchor system 22. The worker 20 is working on an elevated platform 24 that is made up of a plurality of concrete slabs 26. The elevated platform 24 is schematically supported by vertical supports 28, which may be made from steel girders or concrete, for example. The safety anchor system 22 prevents the worker 20 from falling off of the elevated platform 24 a distance that would be great enough to result in injury to the worker.

Figure 2:
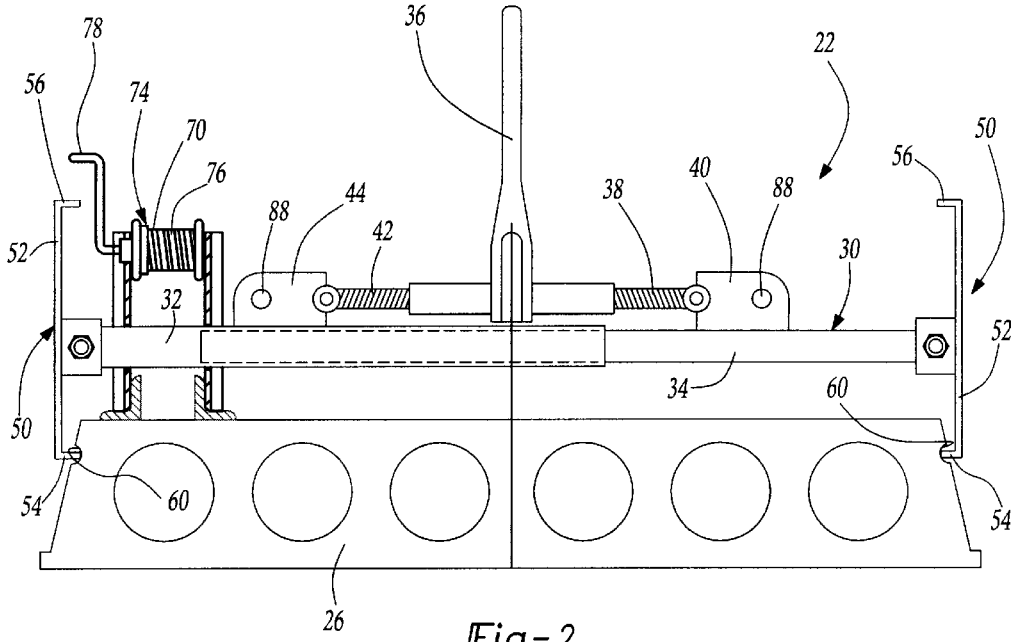
FIG. 2 illustrates, in somewhat more detail, an anchor device from the embodiment of FIG. 1.

Referring to FIG. 2, the safety anchor system 22 preferably includes first and second anchor devices 30. FIG. 2 only illustrates one of the anchor devices 30. A first tube member 32 preferably has an opening at one end for receiving a portion of a second tube member 34. A load binder 36 includes a handle that is manually adjustable by a worker 20.

The load binder 36 preferably is a ratchet type adjustment device that operates in conjunction with a threaded member 38 that is connected to a mounting plate 40, which is secured to the second member 34. A similar threaded member 42 is connected with a similar mounting plate 44, which is secured to the first tube member 32. By appropriately manipulating the handle of the load binder 36, a worker can adjust the effective width of the anchor device to selectively put it into position on an elevated platform.

The first and second tube members 34 include latching members 50 at outward ends. Each latching member 50 preferably includes a plate portion 52 and extensions 54 and 56 at opposite edges of the plate portion 52. The two separate extensions 54 and 56 effectively provide two different sized hooks at the outward ends of the first and second tube members 32 and 34, respectively.

The spacing between the extension 54 and the center of the plate portion 52 preferably is different than the spacing between the extension 56 and the center of the plate portion 52. Providing different spacing renders the anchor device 30 capable of accommodating different sized concrete panels. In the most preferred embodiment, the concrete panels 26 include grooves 60 along the side surfaces as schematically illustrated in FIG. 2. The extensions 54 are shown engaging the grooves 60 and, upon appropriate adjustment of the load binder 36, the anchor device 30 is secured in place on the concrete slab 26. In the preferred embodiment, the dimensions of the latching members 50 provide for the first extension 54 to be useful with 6", 8" and 10" concrete slabs while the extensions 56 are useful with 12" concrete slabs. Providing different dimensions, of course, allows the anchor device 30 to be useful to accommodate other dimensional configurations.

In the preferred embodiment, the width of the anchor device 30 preferably is adjustable between an "open" position where the width is greater than 4' and a "closed" position where the width is less than 4'. In the currently preferred embodiment, the range of motion to adjust the width of the anchor device 30 is approximately 3".

Referring again to FIG. 1, the safety anchor system 22 includes an extension member 70 that extends between the first and second anchor devices 30. One end 72 of the extension member 70 preferably is secured to a connector 73 provided on one of the anchor devices 30. The other end of the extension member 70 preferably is secured to the other anchor device 30. In the preferred embodiment, the extension member 70 is a cable.

An adjustment mechanism 74 (best seen in FIG. 2) preferably is provided to adjust the length of the cable 70 extending between the first and second anchor devices 30. The adjustment mechanism 74 preferably includes a spool 76 and a handle 78 for manually adjusting the length of the extension member 70 when it is extended between the anchor devices 30. The spool 76 and handle 78 preferably are mounted in a secure manner to the corresponding anchor device 30. The spool and handle arrangement preferably are of a ratchet type that maintains a desired tension on the cable 70 after it has been adjusted.

Each of the workers 20 has a tether 80 extending between a harness 82, which is worn by the worker, and a second end 84, which is secured to the extension member 70. The end 84 of the tether 80 preferably is secured to the extension member 70 in a manner that permits the tether to move along the entire length of the extension member 70. A variety of loop fasteners or clamping members are available for this purpose.

The safety anchor system 22 preferably includes a tether retracter 86, which biases the end of the tether connected to the harness 82 toward the end 84 of the tether 80. The retractor 86 preferably has a housing and a spring-loaded spool that winds the tether 80 and receives it within the housing. The bias provided by the tether retractor 86 preferably is light enough that a worker does not have difficulty moving about the elevated platform 24 as desired without experiencing too much tension on the tether 80. The tether retractor 86 preferably is provided to keep the effective length of the tether 80 at a minimum to minimize the possibility for a worker to have the tether 80 become tangled on equipment that is placed on the platform 24, for example.

Although the illustrated embodiment shows the tether 80 secured to the extension member 70, it is also possible to secure a tether 80 directly to one of the anchor devices by connecting the end 84 to a tie off point 88 on one of the mounting plates 40 or 44, for example. This constant tie arrangement may be beneficial or necessary in some situations.

Figure 3A:
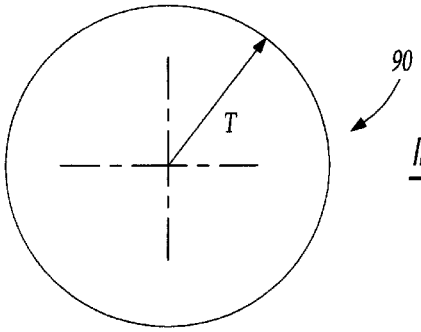
FIGS. 3A and 3B schematically illustrate an advantage of this invention compared with prior designs.
Figure 3B:
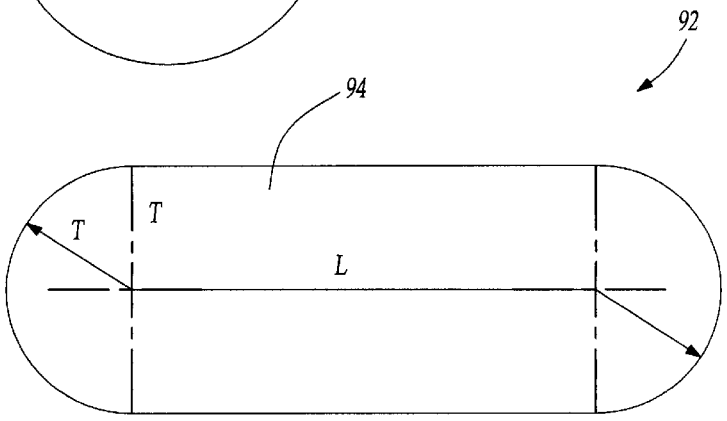

With this invention, a worker is provided with a much greater range of motion than has been previously available with safety anchor devices. As can be appreciated by referring to FIG. 3A, when a single anchor device is utilized, the length of the tether restricts the amount of movement of the worker on the platform. Providing a greater range of motion is not as simple as extending the length of a tether. If the length becomes too long, the worker is susceptible to injury if he falls off one side of the elevated platform 24, for example. With a single anchor device and a standard tether, a worker has a range of motion that is illustrated at 90 in FIG. 3A. Since the tether effectively has a single connection point, the range of motion can be described as a circle having an area that depends on the length T of the tether. Taking an example where the tether has a two meter length, the range of motion for a worker is approximately 12.5 meters$^2$. FIG. 3B, on the otherhand, has a far greater range of motion 92, which results from using a safety anchor system 22 designed according to this invention. The rectangular portion 94 is provided by the combination of the extension member 70 and the tether 80 being moveable along the extension member. At each end of the extension member 70 a semicircle area is available for the range of motion. Considering an example where the extension member 70 has a length L of six meters and the same tether T as used in the previous example, the overall range of motion available to a worker is approximately 36.5 meters$^2$. Therefore, in one example, using this invention results in three times the range of motion for a worker. Having the same length tether simultaneously provides the worker with security from falling off an edge of the elevated platform 24 a distance that would be far enough to result in injury.

As can be appreciated, a safety anchor system designed according to this invention provides a worker with a wider range of motion to move about on an elevated platform. It follows, that a safety anchor system designed according to this invention results in greater economies because a worker need not adjust the position of an anchoring device nearly as frequently as would be necessary with other designs. An additional advantage is provided for the health and safety of workers. Reducing the amount of moving required to reposition anchors reduces the mechanics of bending and lifting. This lessens the possibility for back injury or muscle strain. Moreover, a safety anchor system designed according to this invention is more versatile than previous designs because it can accommodate a variety of concrete slab configurations and provide better security.

The description just given is exemplary rather than limiting in nature. Variations and modifications may become apparent to those skilled in the art that do not necessarily depart from the basis of this invention. The scope of legal protection given to this invention can only be determined by studying the following claims.

What is claimed is:

1. A safety anchor system for protecting an individual from falling from an elevated platform, comprising:

a first anchor device having a first member and a second member that is moveable along a longitudinal axis relative to the first member to selectively adjust a width of the first anchor device, the first and second members each having an outward end with a latching member supported on the outward end, the latching member being adapted to latch onto an edge of a concrete panel upon adjustment of the width of the first anchor device, the latching members each including a central portion having a first projection on one side of the axis at a first distance from the axis, and a second projection on an opposite side of the axis at a second distance from the axis extending from the central portion toward a center of the first anchor device, the second distance being greater than the first distance;

a second anchor device having a first member and a second member that is moveable along a longitudinal axis relative to the first member to selectively adjust a width of the second anchor device, the first and second members each having an outward end with a latching member supported on the outward end, the latching member being adapted to latch onto an edge of a concrete panel upon adjustment of the width of the second anchor device the latching members each including a central portion having a first projection on one side of the axis at a first distance from the axis, and a second projection on an opposite side of the axis at a second distance from the axis extending from the central portion toward a center of the second anchor device, the second distance being a greater than the first distance;

an extension member having a length extending between the first and second anchor devices, the extension member being secured to each of the anchor devices;

at least one tether having a first end secured to the extension member that is moveable along the length of the extension member; and a harness secured to a second end of the tether, the harness being adapted to be worn by an individual.

2. The system of claim 1, wherein the extension member comprises a cable.

3. The system of claim 2, including an adjustment device that adjusts the length of the cable to be consistent with a distance between the first and second anchor devices.

4. The system of claim 3, wherein the adjustment device includes a spool that receives at least a portion of the cable, a lever for manually adjusting the portion of the cable received on the spool and a locking mechanism for locking the spool into a position once the length of the cable has been established to a desired length.

5. The system of claim 1, wherein each latching member central portion lies in a plane that is generally perpendicular to the longitudinal axis and the projections comprise a second portion that is generally perpendicular to the central portion and facing toward a center of the corresponding anchor device, the second portion being adapted to engage a groove on a concrete panel.

6. The system of claim 5, wherein each latching member central portion comprises a generally flat metal plate and each second portion comprises a generally flat metal projection extending from one edge of the plate.

7. The system of claim 6, wherein each latching member projection includes a generally flat metal projection extending from an edge of the plate toward the center of the corresponding anchor device and wherein one of the projections is spaced from a center of the metal plate a first distance and the other of the projections is spaced from the center of the metal plate a second distance that is greater than the first distance.

8. The system of claim 7, wherein each anchor device first member comprises a generally hollow first metal tube having an inside dimension and each second member comprises a second metal tube having an outside dimension that is sized such that the second tube is partially received within the first tube and wherein each anchor device includes a ratchet that is manually moveable to adjust relative positions of the first and second tubes to thereby adjust the width of each anchor device.

9. The system of claim 1, including a tether retractor that is biased to retract the tether second end toward the tether first end.

10. A safety anchor system for protecting an individual from falling from an elevated platform that includes at least one concrete panel having sides with grooves, comprising:

a first anchor device having a first tube and a second tube that are selectively moveable relative to each other to selectively adjust a width of said first anchor device, said first and second tubes each having an outside end with a latching member secured to said outside end, each latching member including a plate portion that is positioned nonparallel with a longitudinal axis of a corresponding one of said tubes and a first extension on one side of said longitudinal axis and extending from said plate portion in a direction toward a center of said anchor device and spaced a first distance from said longitudinal axis and a second extension on an opposite side of said longitudinal axis and extending from said plate portion in a direction toward said center of the corresponding anchor device and wherein said second extension is spaced from said longitudinal axis a second distance that is greater than the first distance, said extensions being adapted to be received in the groove on the concrete panel, and a locking portion to selectively lock said first and second tubes relative to each other to maintain a selected width of said anchor device with said extensions engaging the grooves on the concrete panel such that said first anchor device is maintained in a first position on the concrete panel;

a second anchor device having a first tube and a second tube that are selectively moveable relative to each other to selectively adjust a width of said second anchor device, said first and second tubes each having an outside end with a latching member secured to said outside end, each latching member including a plate portion that is positioned nonparallel with a longitudinal axis of a corresponding one of said tubes and a first extension on one side of said longitudinal axis and extending from said plate portion in a direction toward a center of said second anchor device and spaced a first distance from said longitudinal axis and a second extension on an opposite side of said longitudinal axis and extending from said plate portion in a direction toward said center of the corresponding anchor device and wherein said second extension is spaced from said longitudinal axis a second distance that is greater than the first distance, said extensions being adapted to be received in the groove on the concrete panel, and a locking portion to selectively lock said first and second tubes relative to each other to maintain a selected width of said second anchor device with said extensions engaging the grooves on the concrete panel such that said second anchor device is maintained in a second position that is spaced from the first position; and an extension member extending between and secured to said first and second anchor devices.

11. The system of claim 10, wherein said extension member extends in a direction that is generally perpendicular to said longitudinal axes.

12. The system of claim 10, wherein said extension member comprises a cable and the system includes a tether having a first end secured to said cable such that said first tether end is moveable along a length of said cable.

13. The system of claim 12, including a harness secured to a second end of said tether and a tether retractor that biases said tether second end toward said tether first end and wherein said retractor includes a housing that receives at least a portion of said tether.

14. The system of claim 12, including a cable spool supported on said first anchor device and an adjuster for selectively adjusting an amount of said cable that is received on said spool to thereby adjust a length of said cable extending between said first and second anchor devices.

15. The system of claim 10, wherein said plate portion is a generally flat and rectangular metal plate and wherein each said extension and each said second extension is a metal flange extending from a corresponding edge of said metal plate.

16. A safety anchor system, comprising:

a harness to be worn by an individual;

a tether having a first end secured to the harness; and an anchor device secured to a second end of the tether, the anchor device including a first tube and a second tube that are selectively moveable along a longitudinal axis relative to each other to adjust a length of the anchor device, the first and second tubes each having a latching member at an outward end for securing the anchor device to a work platform, each latching member including a central plate portion and having a first projection on one side of the axis at a first distance from the axis, and a second projection on an opposite side of the axis at a second distance from the axis extending from the plate portion toward the center of the anchor device, the second distance being greater than the first distance such that the latching members accommodate different sized work platforms.

17. The system of claim 16, including a retractor associated with the tether.

* * * * *